US011767697B2

(12) United States Patent
Gardner et al.

(10) Patent No.: US 11,767,697 B2
(45) Date of Patent: Sep. 26, 2023

(54) CLOSING DEVICE

(71) Applicants: Robert Paul Gardner, Surrey (GB); Stephen Gardner, Surrey (GB)

(72) Inventors: Robert Paul Gardner, Surrey (GB); Stephen Gardner, Surrey (GB)

( * ) Notice: Subject to any disclaimer, the term of this patent is extended or adjusted under 35 U.S.C. 154(b) by 0 days.

(21) Appl. No.: 17/508,437

(22) Filed: Oct. 22, 2021

(65) Prior Publication Data

US 2022/0127888 A1 Apr. 28, 2022

(30) Foreign Application Priority Data

Oct. 22, 2020 (GB) ..... 2016759

(51) Int. Cl.
*E05F 1/10* (2006.01)
*E05F 1/12* (2006.01)

(52) U.S. Cl.
CPC ..... *E05F 1/1066* (2013.01); *E05F 1/1269* (2013.01)

(58) Field of Classification Search
CPC ..... E05F 1/1066; E05F 1/1269; E05F 3/227; E05D 7/081
USPC ..... 16/378
See application file for complete search history.

(56) References Cited

U.S. PATENT DOCUMENTS 1,595,722 A 8/1926 Norton
2,035,823 A * 3/1936 Moore ..... E05F 1/1253 16/284
2,468,410 A 4/1949 Schacht
3,174,177 A 3/1965 Bugge
3,656,204 A * 4/1972 Brown ..... E05F 3/106 188/289
3,657,766 A * 4/1972 Peterson ..... E05F 1/14 16/281
5,623,747 A * 4/1997 Marinoni ..... E05F 3/00 16/49
6,553,622 B2 * 4/2003 Maruyama ..... E05F 1/1269 16/277
6,845,545 B2 * 1/2005 Han ..... F25D 23/028 312/319.2

(Continued)

FOREIGN PATENT DOCUMENTS

CH 244543 A 9/1946
DE 1017050 B 10/1957

(Continued)

OTHER PUBLICATIONS

Intellectual Property Office (IPO), Search Report issued in corresponding UK application No. GB2114951.3, dated Mar. 31, 2022, 2 pp.

(Continued)

*Primary Examiner* — Jeffrey O'Brien
(74) *Attorney, Agent, or Firm* — Dinsmore & Shohl LLP

(57) ABSTRACT

A compact, easily mountable door closer, particularly suited for use in cubicles provided in public washrooms, has a pivot member mounted substantially within a hollow body but has a section projecting from the body from which a door is, in use, suspended. A biasing element is provided to bias the pivot member toward a neutral position coincident with the door being closed. As the door and thus the pivot member is displaced away from the closed or neutral position to a defined angle, the biasing element and pivot member engage to provide a limit or fully open position.

18 Claims, 5 Drawing Sheets

(56) References Cited

U.S. PATENT DOCUMENTS

| | | | | |
|---|---|---|---|---|
| 7,357,231 | B2 * | 4/2008 | Kim | F24C 15/023 188/290 |
| 8,499,415 | B2 * | 8/2013 | Bai | E05F 3/225 16/378 |
| 8,793,838 | B2 * | 8/2014 | McKibben | E05F 3/227 16/72 |
| 8,984,717 | B1 * | 3/2015 | Jackson | E05F 1/1253 16/273 |
| 9,095,214 | B2 * | 8/2015 | White | E05F 1/1253 |
| 9,097,051 | B2 * | 8/2015 | Hellwig | E05F 3/22 |
| 9,714,534 | B1 * | 7/2017 | DeGott | E05F 3/108 |
| 10,822,853 | B2 * | 11/2020 | Yu | E05F 3/223 |
| 2003/0070255 | A1 | 4/2003 | Huang | |
| 2011/0030167 | A1 | 2/2011 | Chiang et al. | |
| 2015/0074941 | A1 * | 3/2015 | Park | E05D 7/00 16/54 |

FOREIGN PATENT DOCUMENTS

| | | | |
|---|---|---|---|
| DE | 1034063 | B | 7/1958 |
| EP | 0545679 | A1 | 6/1993 |
| FR | 2712022 | A1 | 5/1995 |
| GB | 2381292 | A | 4/2003 |
| GB | 2479145 | A | 10/2011 |
| GB | 2508793 | A | 6/2014 |

OTHER PUBLICATIONS

Intellectual Property Office (IPO), Search Report issued in corresponding UK application No. GB2016759.9, dated Apr. 6, 2021, 2 pp.

* cited by examiner

CLOSING DEVICE

CROSS-REFERENCE TO RELATED APPLICATION

This application claims priority to UK application number GB 2016759.9 filed Oct. 22, 2020, the disclosure of which is hereby incorporated by reference in its entirety.

FIELD OF THE INVENTION

This invention relates to a closing device and in particular, though by no means solely, to a closing device for inclusion in the mounting of a door incorporated in a cubicle of a public washroom or bathroom.

BACKGROUND OF THE INVENTION

In our published UK Patent Application No. GB 2508793 we describe a door closer from which a door, incorporated in a washroom cubicle, is suspended. While the described device performs extremely well, skill is required to correctly position and fix the device; and the working parts are relatively bulky and open to the surroundings. This latter feature means that the working parts are at least potentially exposed to corrosive cleaning chemicals used in washrooms and are also potentially exposed to unwanted tampering.

It is an object of the invention to provide a door closer which goes at least some way to addressing the abovementioned issues; or which will at least provide a novel and useful choice.

SUMMARY OF THE INVENTION

Accordingly, the invention provides door closing apparatus including: an elongate body of substantially constant cross section, the body having a length axis and an interior void; a pivot member located, at least in part, within the elongate body, having an outer surface, and constructed and arranged to rotate about a pivot axis; biasing element located within the elongate body and mounted between the body and the pivot member to bias the pivot member toward a neutral position in which bias applied by the biasing element is at a minimum; and a damping means operable to damp rotation of the pivot member relative to the housing wherein the biasing element, in combination with the pivot member is configured such that as the pivot member is rotated a defined angle from the neutral position, the biasing element engages the outer surface to limit further rotation of the pivot member.

Preferably the elongate body, when viewed along the length axis, has a substantially uniform outer shape.

Preferably the pivot member includes a door mount projecting through an aperture in the elongate body.

Preferably the aperture is symmetrical about a longitudinal centreline of a face of the elongate body.

Preferably a seal is provided between the pivot member and the elongate body where the pivot member projects through the elongate body.

Preferably the seal is incorporated in a bearing.

Preferably the interior void includes a pivot cavity configured to receive the pivot member, the pivot cavity having a linear dimension in the direction of the pivot axis which terminates in a boundary defined by a wall section of the void, and wherein that part of the pivot member located within the housing terminates in an end surface which is substantially parallel to, and is a clearance fit relative to, the boundary.

Preferably the damping means comprises a damping grease located in the pivot cavity and between the end surface and the boundary.

Preferably the outer surface comprises a peripheral surface spaced from and around the pivot axis and wherein part of the biasing element is pivotally attached to the pivot member outwardly of the peripheral surface.

Preferably the pivot member includes a channel extending around and projecting from the peripheral surface, the part of the biasing element being pivotally retained within the channel.

Preferably the biasing element comprises a single coil spring aligned generally along the length axis of the elongate body, a first link configured to pivotally connect the coil spring to the pivot member, and a second link to connect the coil spring to the elongate body.

Preferably the first link is substantially rigid.

Preferably the apparatus further includes an adjuster mounted between the second link and the elongate body, the adjuster being displaceable along the length axis; and a locking element to lock the adjuster relative to the elongate body in a selected position on the length axis.

Preferably the locking element is operable from the exterior of the elongate body.

Preferably the elongate body has an aperture in a wall thereof, through which the position of the adjuster is visible from the exterior of the elongate body Many variations in the way the present invention can be performed will present themselves to those skilled in the art. The description which follows is intended as an illustration only of one means of performing the invention and the lack of description of variants or equivalents should not be regarded as limiting. Subject to the scope of the appended claims, wherever possible, a description of a specific element should be deemed to include any and all equivalents thereof whether in existence now or in the future.

BRIEF DESCRIPTION OF THE DRAWINGS

A working embodiment of the invention will now be described with reference to the accompanying drawings in which.

DETAILED DESCRIPTION OF THE INVENTION

Figure 1:
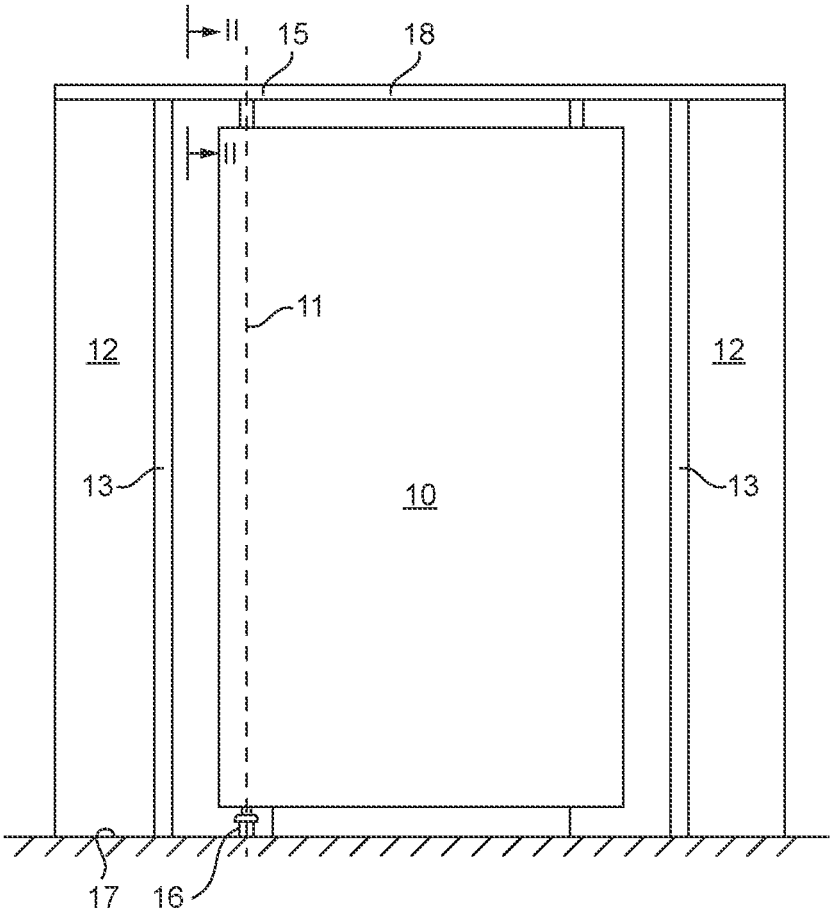
FIG. 1 is an elevational view, looking from the interior, of a typical washroom cubicle installation in which the invention might be used.

Referring to FIG. 1 of the drawings, the invention provides a door closer device and preferably door closer device incorporated in a hinge which is particularly suited for application to a cubicle forming part of a public washroom or bathroom facility. Looking from the interior, such a cubicle typically includes a door 10 pivoted about pivot axis 11, fascia members 12 and side walls 13.

In the particular example shown in FIG. 1, the door 10 is suspended from upper hinge/closer 15 (hereafter simply referred to as closer 15) and is further supported by a lower hinge 16 mounted on floor 17. The closer 15 will described in greater detail 15 below while the lower hinge 16 does not form part of the invention and can take any suitable form.

Figure 2:
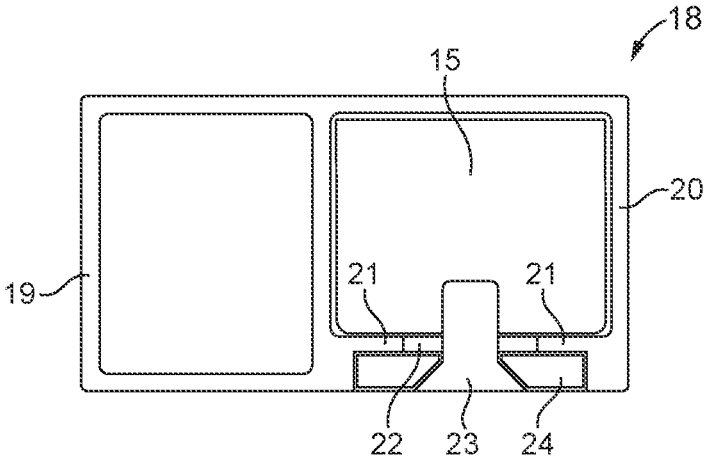
FIG. 2 is an enlarged view along the section II-II in FIG. 1.
Figure 3:
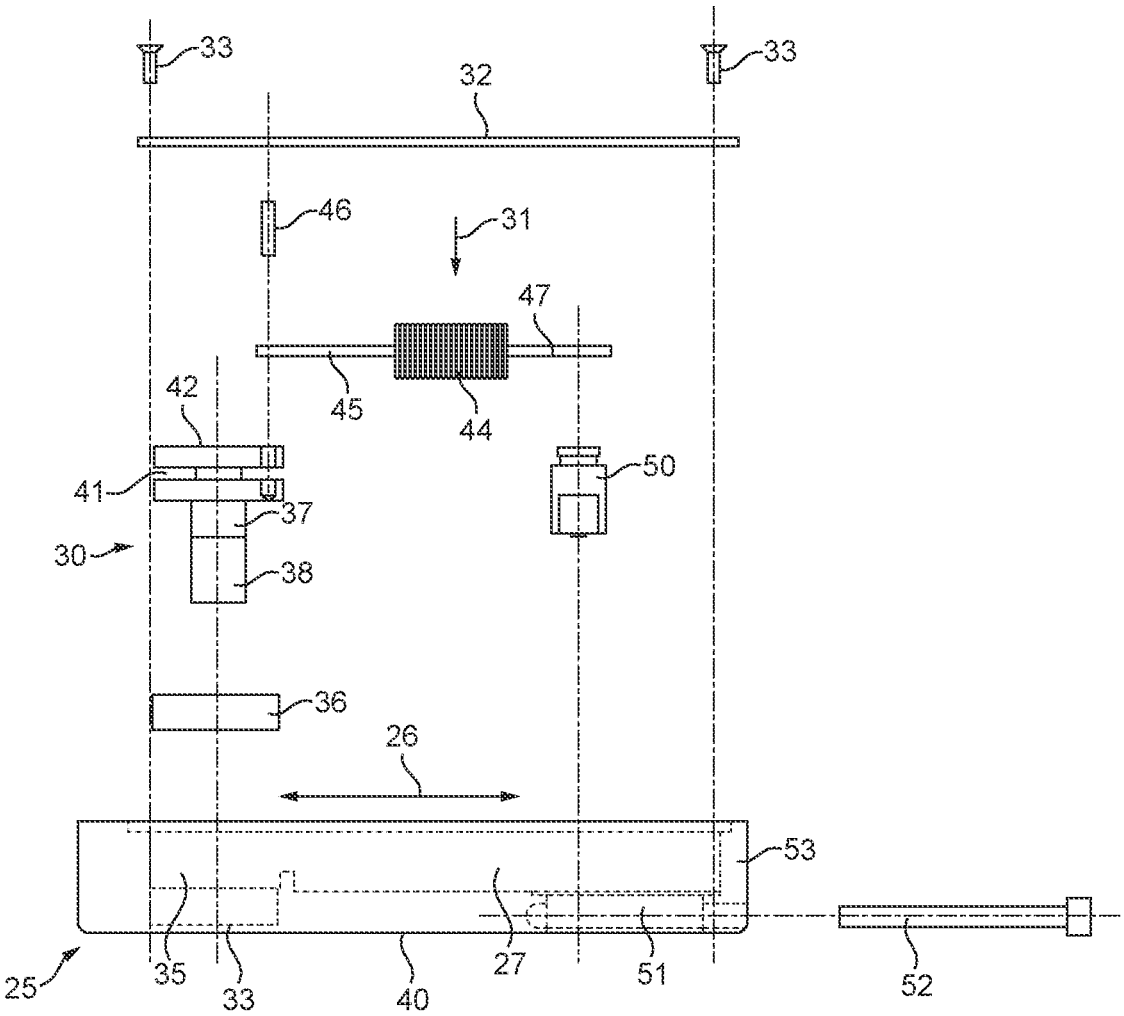
FIG. 3 is an exploded view, partly in section, of a door closer according to the invention.

As will be apparent from the description that follows, the closer 15 is conveniently mounted on a cross member 18 forming part of the frame of the cubicle. As can be seen in FIG. 2, in this example the cross member 18 comprises a metal, for example 20 aluminium, extrusion having a main rectangular structural element 19 and a downwardly facing retaining section 20 to receive and support the closer 15 and, in so doing, offset the pivot axis 11 from the plane of the rear surfaces of the facia members 12. As shown, the retaining section 20 is substantially rectangular in cross-section, the lower edge of which is defined by spaced flanges 21 between the outer edges of which a longitudinal slot 22 is defined. The slot 22 provides a space through which part of the closer 15 extends for engagement with the door 10, and also provides access for a locking screw 23 to engage in the body of the closer 15. In this case the locking screw 23 is retained on the outside of the cross member 18 by a clamping plate 24 such that, as the screw 23 is tightened in the body of the closure, the base surface of closer 15 is drawn into contact with, and locked against, the flanges 21.

Turning now to FIGS. 3 to 8, the closer according to the invention comprises an elongate body 25 of substantially constant cross section, the body 25 having a length axis 26 and an interior void 27 in which the operative parts of the closer are housed. As can best be seen in FIG. 2 the exterior shape of the elongate body 25, when viewed along the length axis 26, is substantially rectangular and the body can thus be housed within, and positioned at any suitable location along, channel 20 in the cross member 18; and then locked in position using screw 23 and clamping plate 24.

Located within the interior void 27 of this embodiment of closer is a pivot member 30, biasing element 31, and damping means (not shown), further details of which follow below. With these components installed within the void 27, the body can be closed by a cover plate secured to the body 25 by machine screws 33, the cover plate 32 defining the upper boundary of the void 27.

The pivot member 30 is mounted for rotation about pivot axis 11 in a pivot cavity 35, forming part of the void 27, by way of a bearing 36, preferably a sealed bearing. The pivot member 30 preferably takes the form of a spindle having a round peripheral surface 37 positioned within the void 27 and a door mounting section 38 that projects through an aperture 39 provided on the longitudinal centreline of the base surface 40 of the body 25. When mounted in cross member 18, the door mounting section 38 also projects through slot 22 to provide a mount for the door 10. The pivot member 30 further includes a peripheral channel 41 defined by spaced flanges projecting from, and extending around, the peripheral surface 37. The length of the member 30, in the direction of the pivot axis 11, is set so that, when assembled into the pivot cavity 35, end surface 42 of the member 30 is a close clearance fit with the inner surface of the cover plate 32.

Figure 4A:
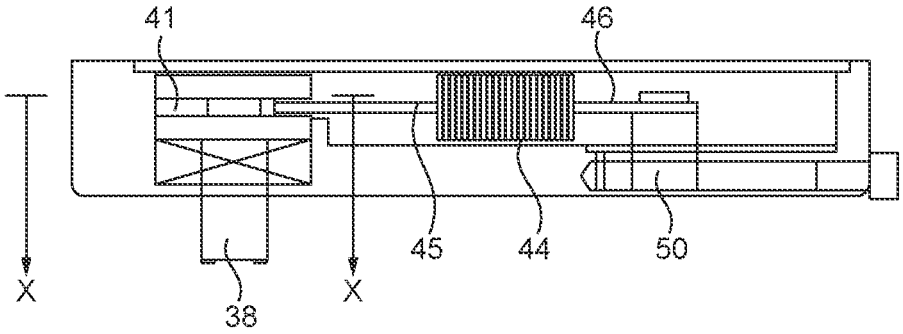
FIG. 4A is a vertical part section of a door closer according to the invention in a rest or closed position.
Figure 4B:
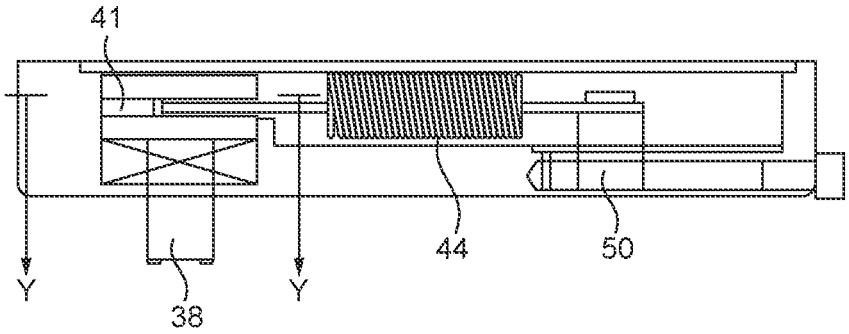
FIG. 4B is a similar view to FIG. 4A but with the closer in an open or biased position.
Figure 5A:
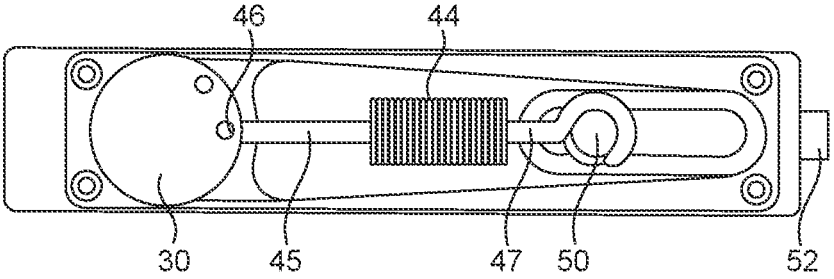
FIG. 5A is a plan view of the closer components in the state shown in FIG. 4A.
Figure 5B:
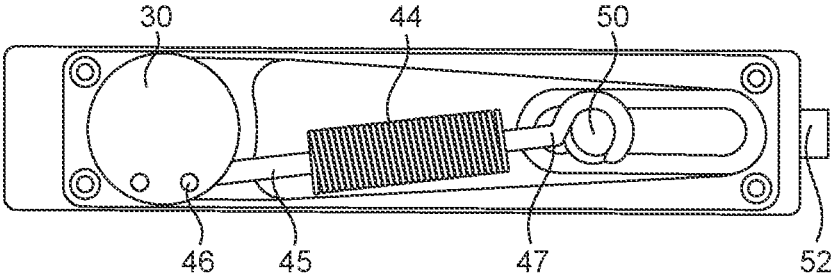
FIG. 5B is a plan view of the closer components in the state shown in 20 FIG. 4B.
Figure 6:
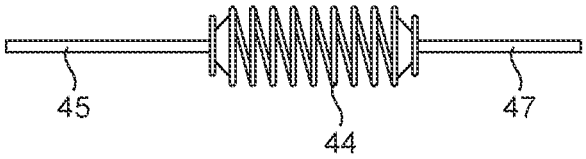
FIG. 6 is an enlarged elevational view of a biasing arrangement shown in FIGS. 4 & 5.
Figure 7:
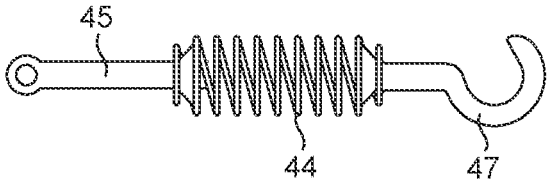
FIG. 7 is a plan view of the biasing arrangement shown in FIG. 6.

The biasing element 31 is aligned in the general direction of the length axis 26 and is configured and arranged to bias the pivot member 30 to a neutral position; that is to say, a position in which the bias applied by the biasing element on the pivot member is at a minimum as shown in FIGS. 4A & 5A. In use, this corresponds to a door closed position. When the door 10 is displaced away from the closed position, as shown in FIGS. 4B & 5B, bias on the pivot member 30 is increased so that, in the known manner when the force displacing the door open is removed, the pivot member 30, and thus the door 10, will return to the closed or neutral position under the influence of the biasing element 31.

In the form shown, the biasing element 31 comprises a single coil spring 44 and two links. A first link 45 projects from one end of the coil spring 44 and is held in the peripheral channel 41 by means of pivot pin 46. As can be seen in FIGS. 5A & 5B, alternative mounting positions are provided for the pivot pin 46 to allow the closer to be readily adapted to mount a door with a left-hand or a right-hand pivot axis and also allow the door to open either inwardly or outwardly. The second link 47 projects from the opposite end of the coil spring 44 and is fixed to the body 25, preferably by way of an adjuster 50.

Figure 8A:
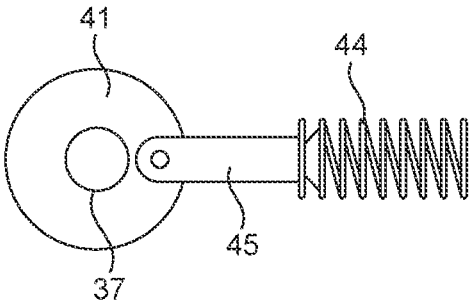
FIG. 8A is an enlarged view along the section x-x in FIG. 4A.
Figure 8B:
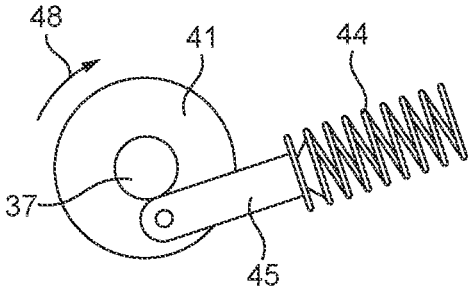
FIG. 8B is an enlarged view along the section y-y in FIG. 4B

A particular feature of the invention is that the pivot member 30 and the biasing element 31 are, in combination, configured so that as the pivot member 30 is rotated to a defined angle, in this example about 90°, from the neutral position, the biasing element 31 and pivot member 30 engage to limit further rotation of the pivot member. Referring now to FIGS. 8A and 8B, link 45 is shown fixed within channel 41 by pivot pin 46, the axis of the pivot pin being outward of the peripheral surface 37. As the door is displaced from the neutral position shown in FIG. 8A, in the direction of arrow 48 in FIG. 8B, the link 45, which is preferably relatively rigid, is displaced into contact with the peripheral surface 37 of the pivot member 30. This effectively comprises a limit stop for the closer 15 but because the link is attached to spring 44, the stop is not a hard stop. Further, each of the links 45 and 47 is preferably connected to the coil spring 44 in a manner that allows some twisting deflection of the links with respect to the spring axis. This, in combination with the pivotal location of link in channel 41 allows an effective bias to be imposed on the pivot member 30 by a single spring over a 90° arc with minimal lateral displacement of the components. This, in turn, means that the overall width of the closer can be kept very compact. To this end, each link conveniently includes a flared inner section 55 that engages within the spring coils to fix the link to the spring yet allow the twisting deflection referred to above.

The adjuster 50 locates within a channel 51 formed in the base of the interior void 27 and, in this example, the position of the adjuster in the channel 51 is both varied by, and locked by, a cap screw 52. The cap screw 52 is passed through a hole in an end 53 of the body, engaged in the adjuster 50 and can be rotated by a tool external to the closer to vary the position of the adjuster in the channel, and thus the degree of bias imposed by the biasing element 31 on the pivot member 30. A slot (not shown) may be provided in base wall 40 to allow the position of the adjuster 50 to be viewed.

The damping means provided to damp the closing action preferably comprises a damping grease (not shown) which is placed in the void 27 and, more particularly in the pivot cavity 35, so as to surround the pivot member. The grease is also preferably provided between the end face 42 of the pivot member 32 and the inner surface of the cover plate 32. Any suitable grade of grease may be used, one suitable example being a grease having a kinematic viscosity at 40° C. in the range 150000 to 250000 cSt when tested according to ASTM D-445.

It will thus be appreciated that a closer according to the invention is not only compact, easily positioned and fixed in place, but the operative parts are protected from harmful substances and unintended tampering.

The invention claimed is:

1. A door closing apparatus, comprising:

an elongate body of constant outer cross section, the elongate body having a length axis and an interior void;

a pivot member located, at least in part, within the interior void, and constructed and arranged to rotate about a pivot axis, the pivot member including a first section and a second section arranged on the pivot axis, the second section being smaller in diameter than the first section;

a biasing element located within the interior void and mounted between the elongate body and the pivot member to bias the pivot member toward a neutral position in which bias applied by the biasing element is at a minimum; and a damping means operable to damp rotation of the pivot member relative to the elongate body, wherein the biasing element, in combination with the pivot member, is configured such that as the pivot member is rotated a defined angle from the neutral position, the biasing element directly contacts an outer peripheral surface of the second section to limit further rotation of the pivot member.

2. The apparatus as claimed in claim 1, wherein the elongate body, when viewed along the length axis, has a uniform rectangular outer shape.

3. The apparatus as claimed in claim 1, wherein the pivot member includes a door mount projecting through an aperture in the elongate body.

4. The apparatus as claimed in claim 3, wherein the aperture is symmetrical about a longitudinal centreline of a face of the elongate body.

5. The apparatus as claimed in claim 3, wherein a seal is provided between the pivot member and the elongate body where the pivot member projects through the elongate body.

6. The apparatus as claimed in claim 5, wherein the seal is incorporated in a bearing.

7. The apparatus as claimed in claim 1, wherein the interior void includes a pivot cavity configured to receive the pivot member, the pivot cavity having a linear dimension in a direction of the pivot axis which terminates in a boundary defined by a wall section of the elongate body, and wherein that part of the pivot member located within the elongate body terminates in an end surface which is parallel to, and is a clearance fit relative to, the boundary.

8. The apparatus as claimed in claim 7, wherein the damping means comprises a damping grease located in the pivot cavity and between the end surface and the boundary.

9. The apparatus as claimed in claim 1, wherein the outer peripheral surface is spaced from and around the pivot axis and wherein part of the biasing element is pivotally attached to the pivot member outwardly of the outer peripheral surface.

10. The apparatus as claimed in claim 9, wherein the pivot member includes a channel extending around the outer peripheral surface, the part of the biasing element being pivotally retained within the channel.

11. The apparatus as claimed claim 1, wherein the biasing element comprises a single coil spring aligned generally along the length axis of the elongate body, a first link configured to pivotally connect the coil spring to the pivot member, and a second link to connect the coil spring to the elongate body.

12. The apparatus as claimed in claim 11, wherein the first link is rigid.

13. The apparatus as claimed in claim 11, further including an adjuster mounted between the second link and the elongate body, the adjuster being displaceable along the length axis; and a locking element to lock the adjuster relative to the elongate body in a selected position on the length axis.

14. The apparatus as claimed in claim 13, wherein the locking element is operable from the exterior of the elongate body.

15. The apparatus as claimed in claim 13, wherein the elongate body has an aperture in a wall thereof, through which the selected position of the adjuster is visible from the exterior of the elongate body.

16. The apparatus as claimed in claim 1, further comprising:

a cover plate engaged with the elongate body, wherein the elongate body has a base surface, and the cover plate in combination with the base surface defines the interior void.

17. The apparatus as claimed in claim 1, further comprising:

a cover plate engaged with the elongate body, wherein the cover plate defines an upper boundary of the interior void.

18. The apparatus as claimed in claim 1, wherein the pivot member includes a third section larger in diameter than the second section arranged on the pivot axis, the second section is disposed between the first section and the third section.

* * * * *